US006581330B1

(12) United States Patent
Helsloot et al.

(10) Patent No.: US 6,581,330 B1
(45) **Date of Patent: *Jun. 24, 2003**

(54) PACKAGING FOR CUT FLOWERS

(75) Inventors: Joannes Carolus Antonius Helsloot, 'S-Hertogenbosch (NL); Janus Adriaan Willem De Pagter, Dinteloord (NL)

(73) Assignee: Pagter & Partners International B.V., Dinteloord (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/674,810

(22) PCT Filed: May 6, 1999

(86) PCT No.: PCT/NL99/00273

§ 371 (c)(1),
(2), (4) Date: Dec. 14, 2000

(87) PCT Pub. No.: WO99/57040

PCT Pub. Date: Nov. 11, 1999

(30) Foreign Application Priority Data

May 7, 1998 (NL) ..... 1009100

(51) Int. Cl.[7] ..... B65D 85/52; A01G 9/02

(52) U.S. Cl. ..... 47/84; 47/65; 47/41.01; 206/423

(58) Field of Search ..... 47/84, 41.01, 41.11–41.14, 47/65.5, 29.6, 66.1, 86; 206/423; 493/102; 220/4.03, 913; 229/100; D3/201; 150/154; 222/531; D9/414; B65D 85/56

(56) References Cited

U.S. PATENT DOCUMENTS

| | | | | | |
|---|---|---|---|---|---|
| 3,314,194 A | * | 4/1967 | Halleck | | |
| 3,973,356 A | * | 8/1976 | Schacht | | 47/41 R |
| 4,291,493 A | * | 9/1981 | Monson | | 47/14 |
| 4,316,540 A | * | 2/1982 | Lapham | | 206/507 |
| 4,784,112 A | * | 11/1988 | Hayashi | | 126/262 |
| 5,060,799 A | * | 10/1991 | De Pagter | | 206/423 |
| 5,901,904 A | * | 5/1999 | Avot | | 229/109 |

FOREIGN PATENT DOCUMENTS

| | | | | |
|---|---|---|---|---|
| CA | 2080254 | | 4/1994 | |
| EP | 0311174 | | 4/1989 | |
| EP | 0311174 | | 3/1991 | |
| EP | B1 0536613 | | 9/1992 | |
| EP | 0536613 | | 4/1993 | |
| FR | 2616414 | * | 6/1987 | B65D/43/06 |
| FR | 2612888 | | 9/1988 | |
| JP | 06-181833 | * | 7/1994 | A47G/7/06 |
| NL | 9101847 | * | 1/1993 | B65D/21/04 |
| NL | 9101847 | | 6/1993 | |

OTHER PUBLICATIONS

International Search Report PCT/NL99/00273 Jul. 20, 1999.

* cited by examiner

*Primary Examiner*—Peter M. Poon
*Assistant Examiner*—Andrea M. Valenti
(74) *Attorney, Agent, or Firm*—Handal & Morofsky

(57) ABSTRACT

Packaging for cut flowers comprises: a rectangular crate (1) with sloping side walls which are provided close to their top walls with a channel (5, 6, 7) that projects outwards and is open at the top, the base of which channel serves to support a foldable rectangular protective tube (2). In order to be able to nest a number of crates (1) deeply into one another without risk of binding, a shoulder (9) is arranged between the top edge of the sloping side walls of the crate and the base (7) or the bottom end of the inner flange (6) of the channel (5, 6, 7) open at the top. Said shoulder can also serve as support for a rectangular presentation collar.

14 Claims, 9 Drawing Sheets

PACKAGING FOR CUT FLOWERS

The invention relates to a packaging for cut flowers comprising: a rectangular crate with sloping side walls which are provided close to their top walls with a channel that projects outwards and is open at the top, the base of which channel serves to support a foldable rectangular protective tube.

Packaging of this type is known in practice and is essentially described in EP-B 0 311 174.

The purpose of the rectangular tube is to protect those parts of cut flowers placed in the crate which extend above the crate during transport and during presentation at auction or when put up for sale at wholesale markets. A plastic cover is placed on the tube, which cover can be removed in order to assess the quality of the flowers. After the packaging, including tube and cover, has been transported, following auctioning or sale, to a shop or any place in the world, the rectangular tube is removed, the cut flowers fanning out in the crate and not having to be transferred to a bucket.

If the empty crates are nested deeply into one another in order, for example, to be returned to the sender, the inner flange of the channel of a lower crate, which channel is open at the top, could bind on the outer surface of the sloping crate walls of a higher crate, with the result that separating a stack of crates nested in one another presents problems. The aim is so to improve the packaging mentioned in the preamble that the crates can be nested deeply into one another without the risk of binding.

To this end the packaging mentioned in the preamble is characterised in that a shoulder extends between the top edge of the sloping side walls of the crate and the base or the bottom end of the inner flange of the said channel open at the top.

The said shoulder can serve as a support for a rectangular presentation collar. This is important in particular in the case of somewhat longer cut flowers (for example roses with a stem length of 1 meter). After removing the said protective tube the flowers can fan out far beyond the top edge of the crate. The rectangular presentation collar counteract this.

Said presentation collar is shorter than the protective tube, so that the top part of the flower stems with flowers extends well above the top edge of the presentation collar. The presentation collar preferably consists of a foldable tube made of plastic and said collar can be provided with openings and printed with advertising.

Preferably, ribs are arranged on the said shoulder to reinforce the inner flange of the channel open at the top. In this case cut-outs or recesses are arranged in the bottom edge of the presentation collar to allow passage of said ribs.

After having been removed at an angle from the top of the crate, the foldable rectangular protective tube can be utilized to support the crate. To this end he under surface of the base of the channel open at the top can form the base surface of a channel open at the bottom, which is intended to form a seating channel for the top edge of the protective tube if the crate is inserted from above into a rectangular protective tube. The protective tube can have printing with advertising copy or the like.

Usually the crate is provided with hand grip openings in two side faces located opposite one another. In order to anchor the presentation collar, a strip projecting outwards can have been fixed to the bottom edge of each of two opposing walls of said collar, which strip extends through a hand grip opening and engages on the top edge thereof The packaging also comprises a cover that fits on the protective tube. On its top surface the cover is provided with ribs, on which a crate stacked on top can bear in such a way that a ventilation gap is produced between the top surface of the cover and the bottom surface of a crate stacked on top. Said ventilation gap is beneficial for the quality of the packed flowers.

Positioning ridges for lateral positioning of a crate stacked on the cover are preferably arranged on the top surface of the cover, which ridges project above the ribs and are nestable in the case of covers stacked on top of one another. As a result of the nestable ridges, covers stacked on top of one another take up little height when being returned to the sender.

Figure 1:
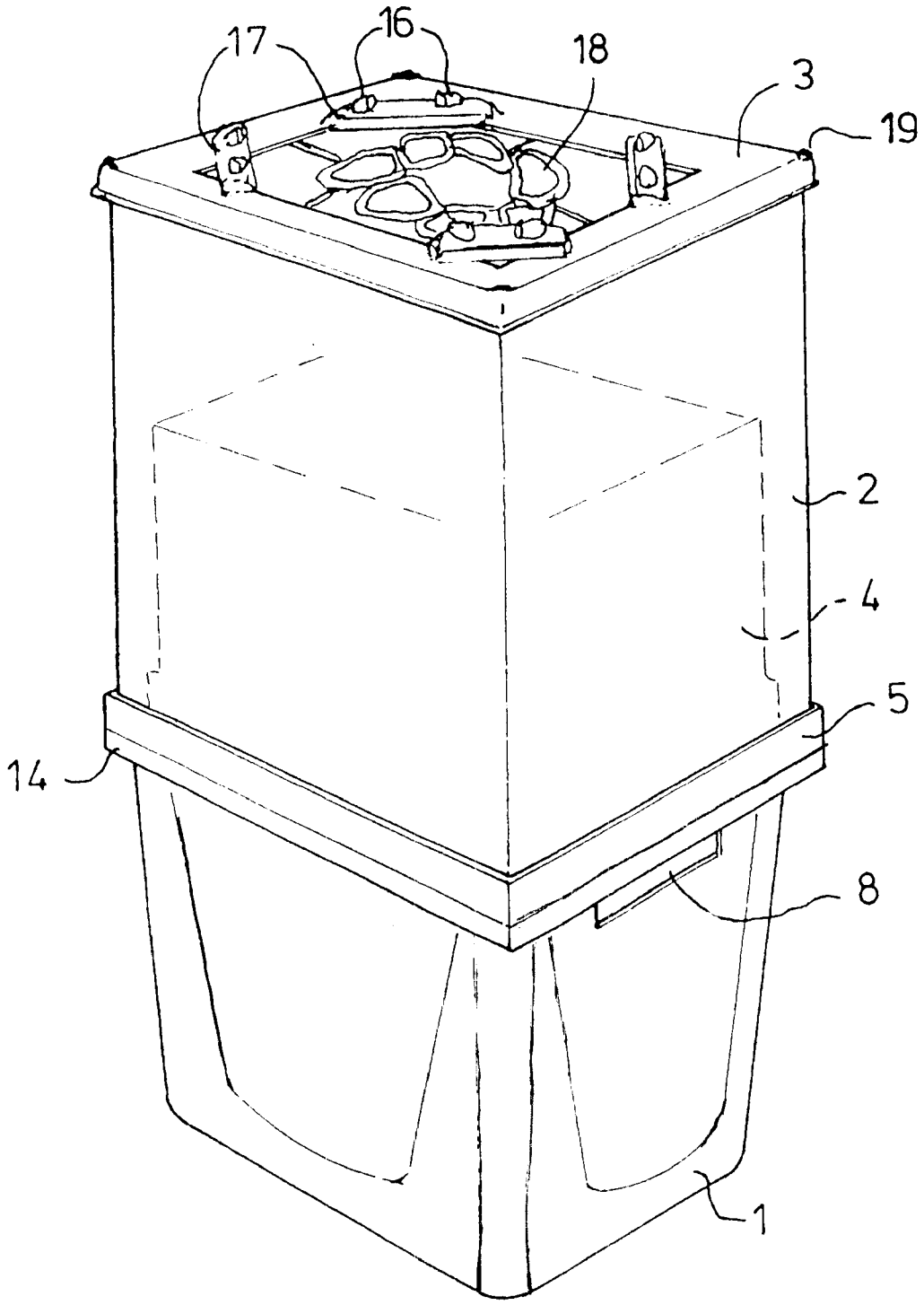
FIG. 1 shows a perspective view of a complete flower packaging according to the invention in the transport position.

The packaging shown for cut flowers comprises a rectangular crate 1 that is usually made of plastic, a rectangular protective tube 2 that is usually made of cardboard or thin plastic and has been folded from a blank, a cover 3 that is usually made of plastic, and a tubular presentation collar 4. The latter can be a useful addition in the case of long flowers but is not necessary. The collar 4 will not be used with short flowers.

At its top edge the crate 1 has a channel which projects outwards and has an outer flange 5, an inner flange 6 and a base 7. The channel 5, 6, 7 is open at the top. The crate has sloping side walls such that it is nestable in a similar crate. There are two relatively long side walls located opposite one another and two short side walls located opposite one another. A hand grip opening 8 has been made in each of the short side walls immediately below the channel 5, 6, 7. The crate can also be square.

Figure 4:
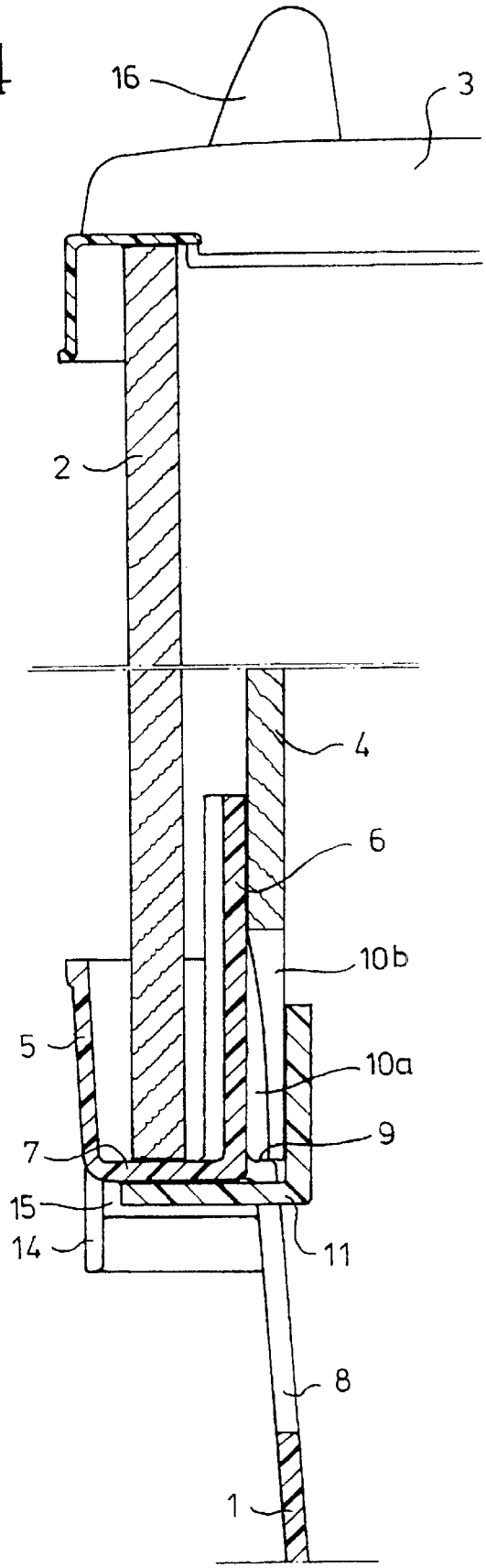
FIG. 4 shows a cross-section at the location of a hand grip opening through part of the side wall of a crate, the protective tube, the cover and the presentation collar in the transport position according to FIG. 1.

In the transport position (see FIGS. 1 and 4) the rectangular protective tube 2 bears on the base 7 of the channel 5, 6, 7 of the crate 1 and the L-shaped peripheral edge of the cover 3 is placed on said tube.

Figure 3:
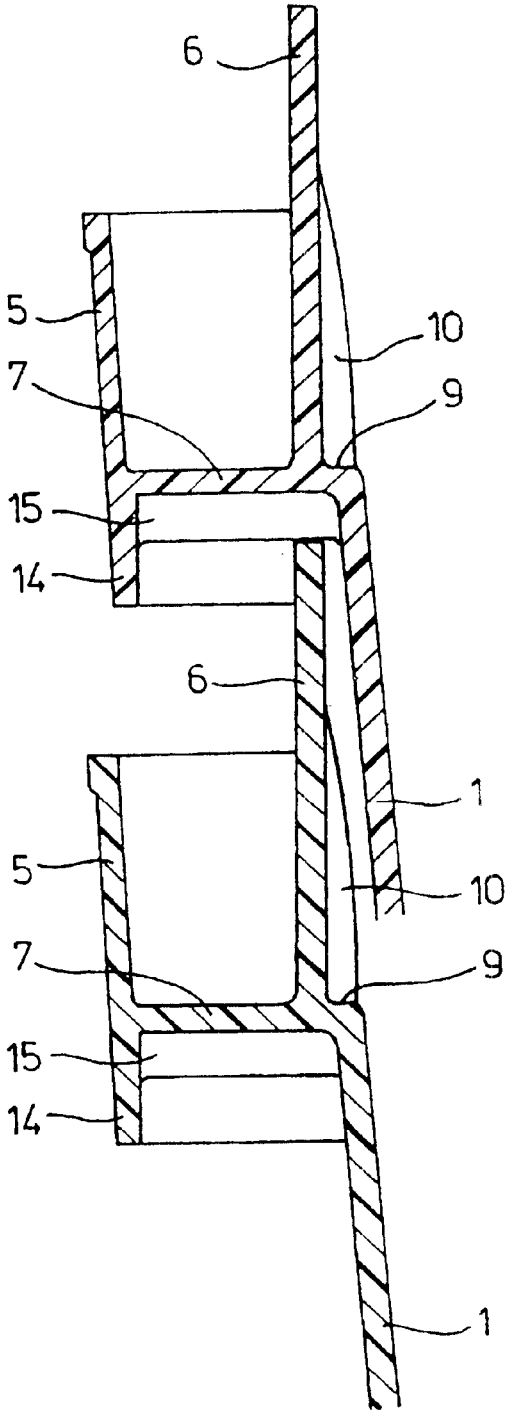
FIG. 3 shows a cross-section through a side wall section of two crates nested in one another.
Figure 7:
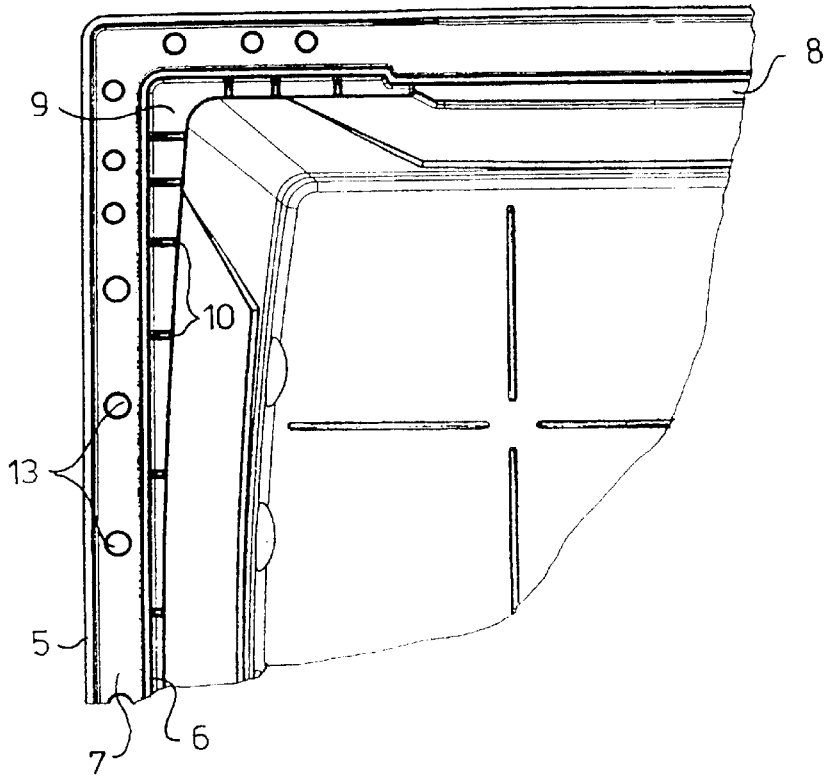
FIG. 7 shows a plan view of the crate.
Figure 8:
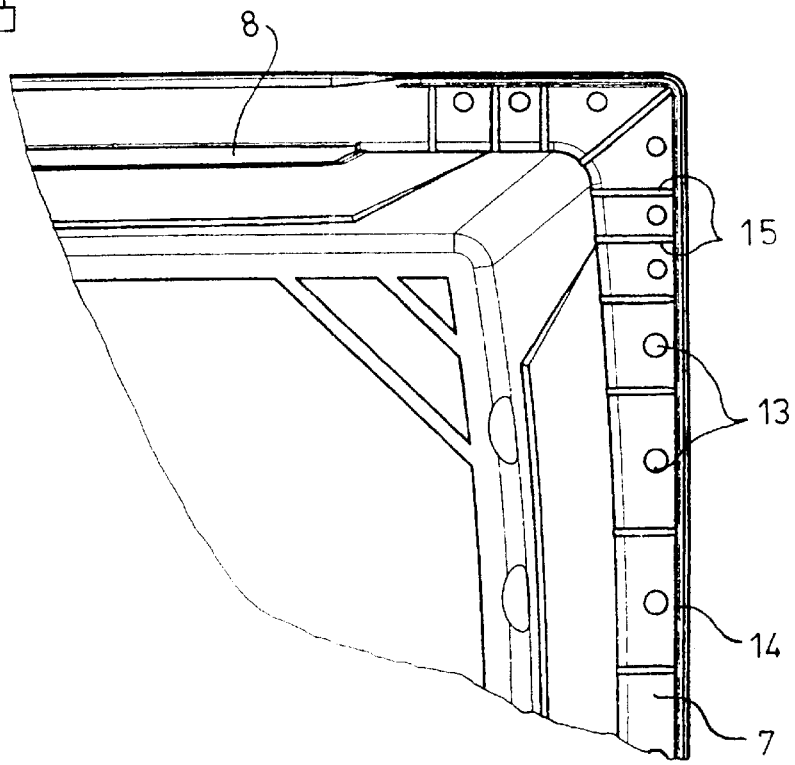
FIG. 8 shows a bottom view of the crate.

A shoulder 9 is arranged on the inside of the channel 5, 6, 7 open at the top, approximately at the height of the base 7 thereof, which shoulder 9, as can be seen from the plan view in FIG. 7, is broadest at the corners of the crate and gradually narrows towards the middle of the side walls of the crate. It is not precluded that the width of the shoulder remains constant As can be seen from FIG. 3, as a consequence of the presence of shoulder 9, the top end of the inner flange 6 of the channel 5, 6, 7, open at the top, of a lower crate will not come into binding contact with the outer surface of a side wall of the higher crate when the crates are nested deeply into one another.

The shoulder 9 is provided with ribs 10*a*, which reinforce the inner flange 6 of the channel open at the top. The shoulder can also serve to support a tubular presentation collar 4 which, for example, is made of a lightweight plastic or an interior to hold individual flowers in place. Said collar 4 serves to prevent the stems of long cut flowers from fanning out too far after removal of the protective tube 2, as a result of which the presentation of the flowers at the point of sale is improved. Cut-outs 10*b*, intended to allow the passage of the ribs 10*a*, have been made in the bottom edge of the collar 4. In order to position the collar 4 firmly on the shoulder 9, use is made of two L-shaped elements 11 fixed to the short sides of the collar 4, the horizontal flange of said elements being inserted through a hand grip opening 8 such that the top surface of said horizontal flange engages on the bottom surface of the base 7 of the channel 5, 6, 7.

Figure 2:
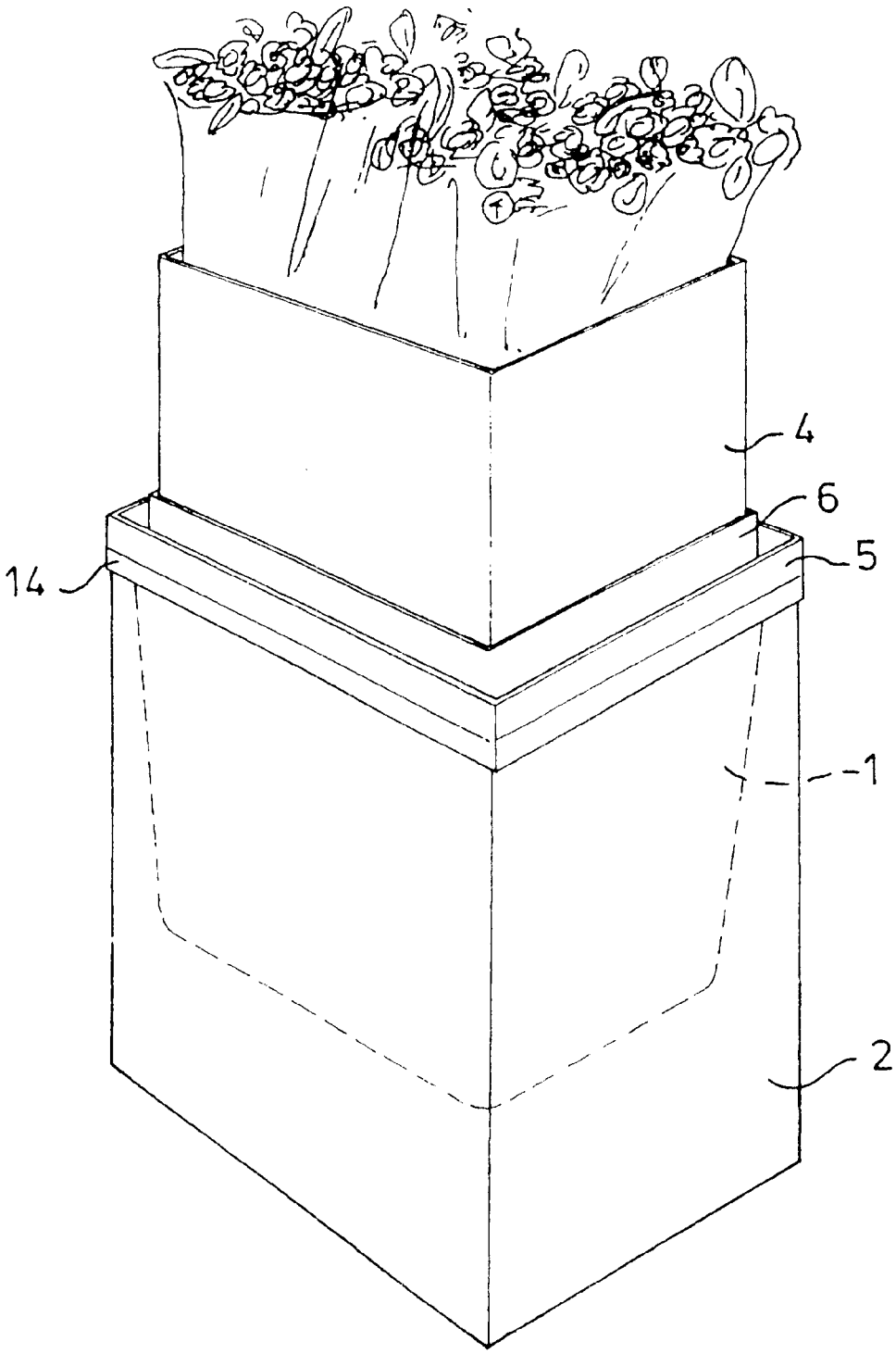
FIG. 2 shows a perspective view of a complete flower packaging according to the invention in the presentation position for long cut flowers.
Figure 5:
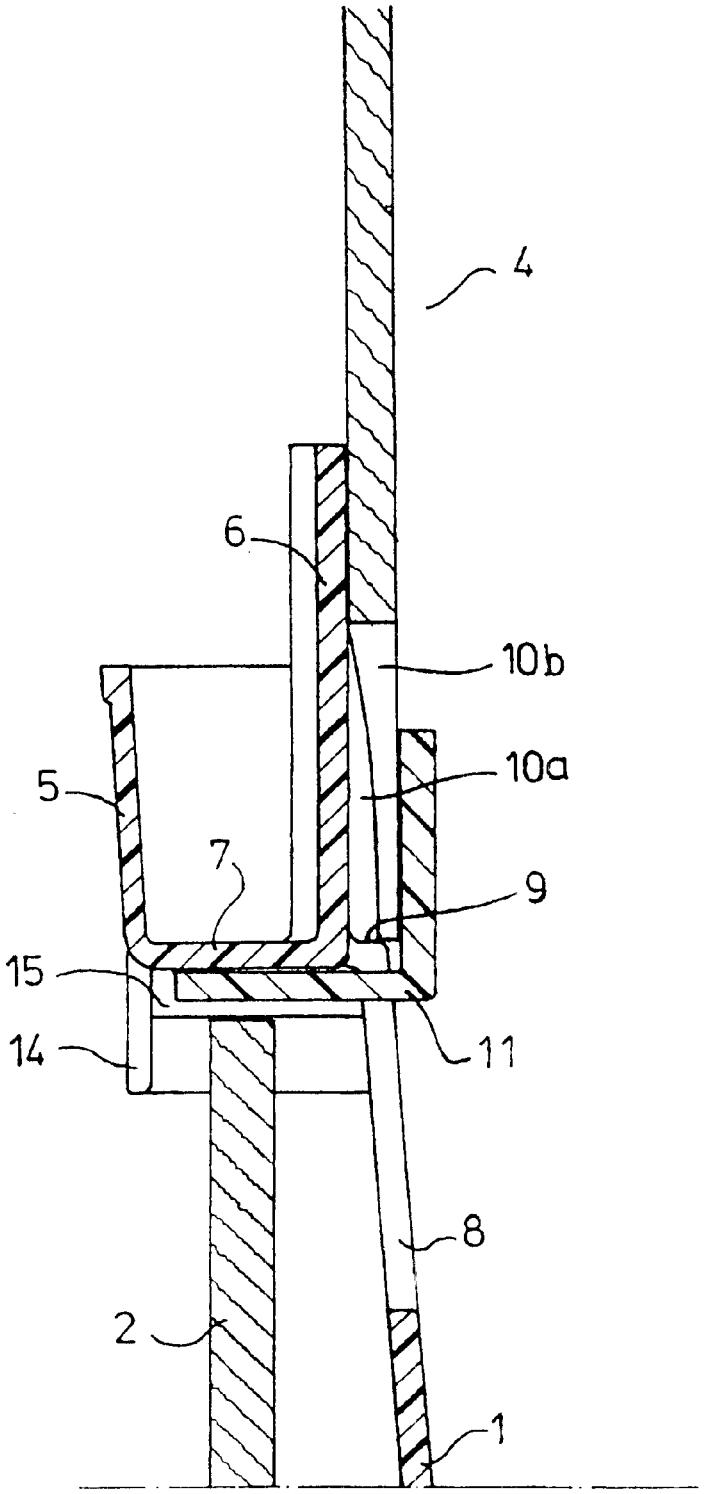
FIG. 5 shows a cross-section through part of the side wall of a crate, the protective tube and the presentation collar in the presentation position according to FIG. 2.

Openings 13 have been made in the base of the channel 5, 6, 7. A channel open at the bottom is arranged on the underside of the base 7 of the channel 5, 6, 7 open at the top, which channel open at the bottom is formed by an outer flange 14, the wall of a crate 1 and the bottom surface of the base 7 of the channel 5, 6, 7. Reinforcing ribs 15 are arranged on said bottom surface, the height of which ribs is appreciably less than that of the outer flange 14. As FIGS. 2 and 5 show, the protective tube 2 is placed on the ground, the top edge of the protective tube 2 extends into the channel 14, 7, 1 open at the bottom and engages on the shallow ribs 15. This position promotes the presentation in the shop, in particular if the protective tube is provided with printing. The outer flange 14 can consist of a number of ridges positioned some distance apart.

Figure 6:
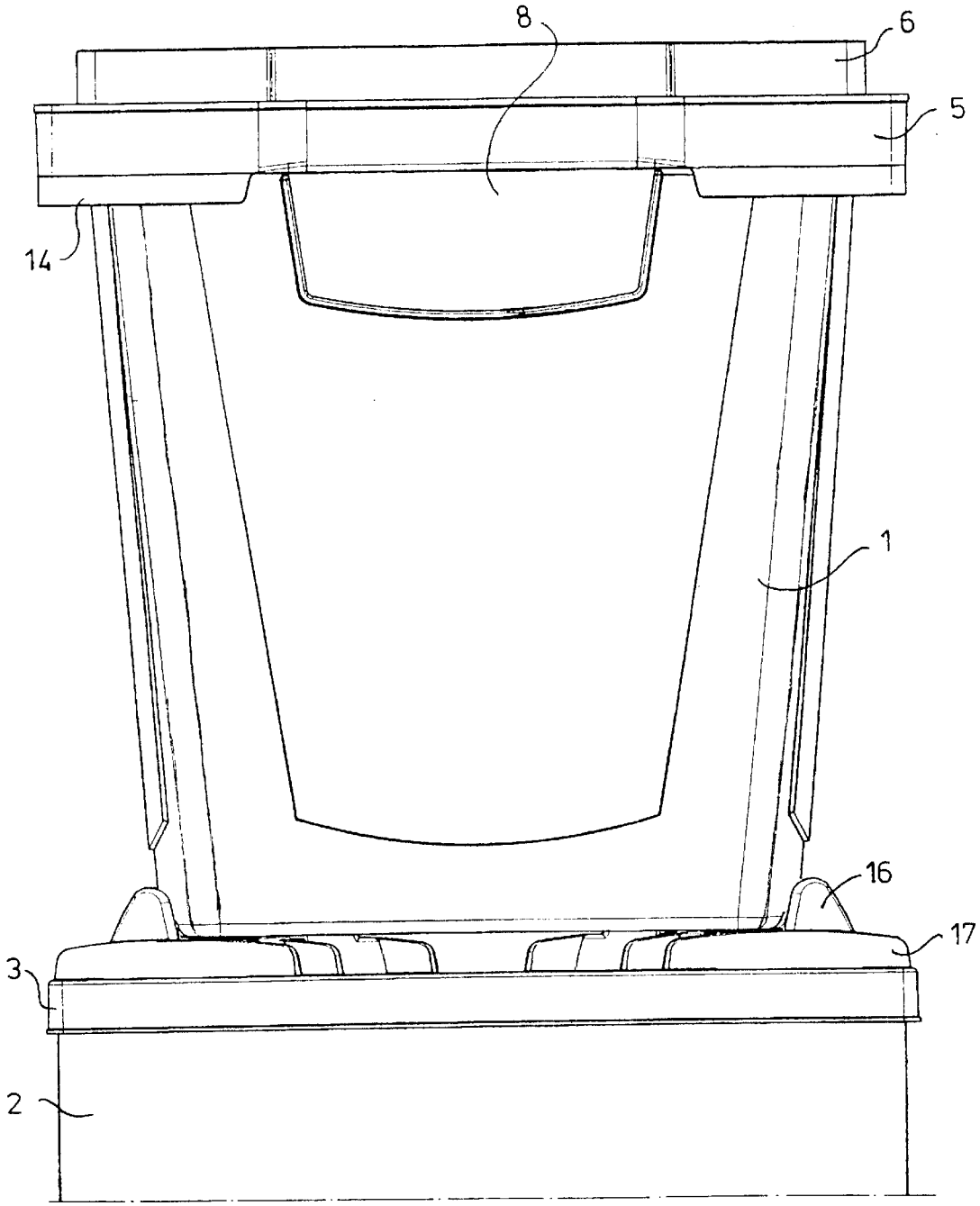
FIG. 6 shows a view of a crate that is bearing on the cover of a crate beneath it.

Four pairs of positioning ridges 16 are positioned on the top surface of the cover. Said ridges protrude above a number of ribs 17. The ridges serve to stop a crate of a subsequent pack stood on the cover of a pack from shifting from the cover. The ridges 16 are nestable when a number of covers are stacked (see FIG. 9). The stack of covers is thus not unnecessarily high. It can be seen from FIG. 6 that the ribs 17 positioned on the top surface of the covers serve as support for a crate stacked thereon, there being a relatively high ventilation gap between the crate and a grid pattern 18 of curved strips.

Small quadrant-shaped ridges 19 are arranged at the four comers of the cover to prevent covers stacked on one another from turning relative to one another. Furthermore, reinforcing strips can have been arranged along the side edges of the cover.

Figure 9:
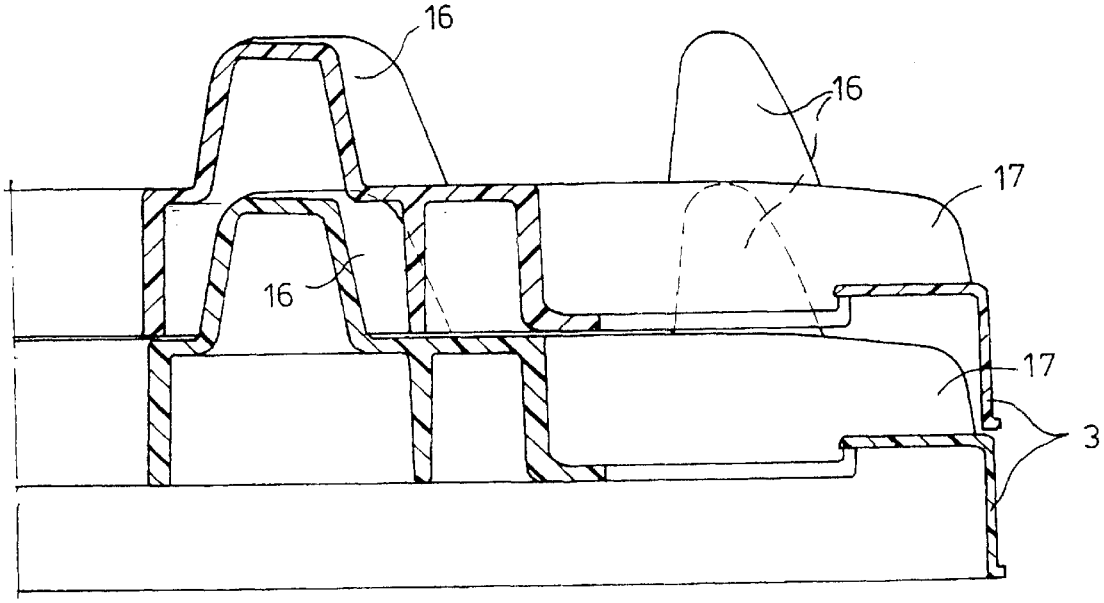
FIG. 9 shows a cross-section of part of a number of covers stacked on one another.
Figure 10:
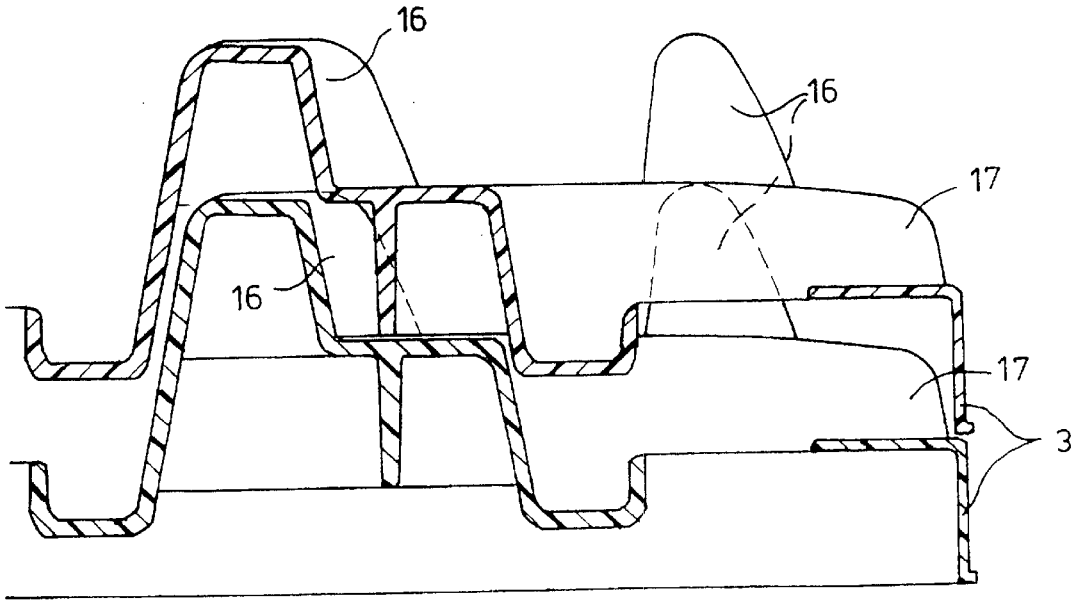
FIG. 10 shows a cross-section of part of a number of covers stacked on one another , according to an alternative embodiment.

The embodiment according to FIG. 10 differs from that according to FIG. 9 in that the ribs 17 have acquired a sloping position, as a result of which they are able to nest. The nest height of the covers remains the same, whilst the ribs can be higher and the covers acquire approximately twice the rigidity. Keeping the nest height constant is important for keeping the transport costs low.

Depending on the height of the loading space in a lorry and on the height of the protective tube, it is possible to stack more than two packagings on top of one another.

What is claimed is:

1. Packaging for cut flowers comprising:

(a) a rectangular crate defining an interior volume, the rectangular crate having sloping side walls;

(b) an upwardly facing channel having a base portion disposed close to the top portion of the sloping walls, the base portion being defined by an inner flange and an outer flange and projecting outwardly of the interior volume, wherein the base of the channel is capable of supporting a foldable rectangular protective tube; and (c) a shoulder projecting into the interior volume and extending between the top of the sloping walls of the crate and the channel base or the bottom of the inner flange of the channel, wherein the shoulder is capable of supporting a rectangular presentation collar or an interior for holding individual flowers in place, wherein the shoulder is further comprises ribs capable of reinforcing the inner flange of the channel and wherein the presentation collar has cutouts on its bottom edge to accommodate the ribs.

2. Packaging for cut flowers comprising:

(a) a rectangular crate defining an interior volume, the rectangular crate having sloping side walls;

(b) an upwardly facing channel having a base portion disposed close to the top portion of the sloping walls, the base portion being defined by an inner flange and an outer flange and projecting outwardly of the interior volume, wherein the base of the channel is capable of supporting a foldable rectangular protective tube, the base of the channel having an upper surface and a lower surface, the lower surface of the base forms a top portion of a downward facing channel defined by an outer surface of the crate and a projection of the outer flange below the base, the downward facing channel being capable of accommodating a top edge of the protective tube and ribs of relatively low height are disposed on the top portion of the downward-facing channel; and (c) a shoulder projecting into the interior volume and extending between the top of the sloping walls of the crate and the channel base or the bottom of the inner flange of the channel.

3. Packaging for cut flowers comprising:

(a) a rectangular crate defining an interior volume, the rectangular crate having sloping side walls;

(b) an upwardly facing channel having a base portion disposed close to the top portion of the sloping walls, the base portion being defined by an inner flange and an outer flange and projecting outwardly of the interior volume, wherein the base of the channel is capable of supporting a foldable rectangular protective tube;

(c) a shoulder projecting into the interior volume and extending between the top of the sloping walls of the crate and the channel base or the bottom of the inner flange of the channel; and (d) a cover fitted on the rectangular crate to bear a crate stacked on top of the cover, the cover having a top surface provided with ribs, the top surface having a topographic grid pattern to provide a ventilation gap between the cover and the crate above.

4. Packaging as claimed in claim 3, wherein the top surface of the cover further comprises lateral positioning ridges, the ridges project above ribs and are capable of being nested when covers are stacked one on top of another.

5. Packaging for cut flowers comprising:

(a) a rectangular crate defining an interior volume, the rectangular crate having sloping side walls and at least two hand grip openings disposed on opposing ones of said side walls;

(b) an upwardly facing channel having a base portion disposed close to the top portion of the sloping walls, the base portion being defined by an inner flange and an outer flange and projecting outwardly of the interior volume, wherein the base of the channel is capable of supporting a foldable rectangular protective tube; and (c) a shoulder projecting into the interior volume and extending between the top of the sloping walls of the crate and the channel base or the bottom of the inner flange of the channel (d) a rectangular presentation collar capable of being supported on the shoulder;

(e) two L-shaped flange elements attached to opposing sides of the collar, each L-shaped element having a flange inserted through a respective one of the hand grip openings of the crate such that a top surface of the inserted flange engages the base portion of the channel.

6. Packaging as claimed in claim 5, further comprising ribs on the shoulder capable of reinforcing the inner flange of the channel wherein the presentation collar has cutouts on its bottom edge to accommodate the ribs.

7. Packaging as claimed in claim 5, wherein the base of the channel has an upper surface and a lower surface, the lower surface of the base forms a top portion of a downward facing channel defined by an outer surface of the crate and a projection of the outer flange below the base, the downward facing channel being capable of accommodating a top edge of the protective tube.

8. Packaging as claimed in claim 7, further comprising ribs of relatively low height disposed on the top portion of the downward-facing channel.

9. Packaging as claimed in claim 5, further comprising a cover fitted on the rectangular crate to bear a crate stacked on top of the cover, the cover having a top surface provided with ribs, the top surface having a topographic grid pattern to provide a ventilation gap between the cover and the crate above.

10. Packaging as claimed in claim 9, wherein the top surface of the cover further comprises lateral positioning ridges, the ridges project above ribs and are, capable of being nested when covers are stacked one on top of another.

11. Packaging for cut flowers comprising:

(a) a rectangular crate defining an interior volume, the rectangular crate having sloping side walls;

(b) an upwardly open channel having a base portion disposed close to a top portion of the sloping walls, the base portion being defined by an inner flange and an outer flange, and projecting outwardly of the interior volume, wherein the base of the channel is capable of supporting a foldable rectangular protective tube;

(c) a shoulder projecting into the interior volume and extending between the top of the sloping walls of the crate and the channel base or the bottom of the inner flange of the channel; and (d) ribs on the shoulder reinforcing the inner flange of the channel; wherein the presentation collar has cutouts on its bottom edge to accommodate the ribs.

12. Packaging as claimed in claim 11, wherein the shoulder is capable of supporting a rectangular presentation collar or an interior for holding individual flowers in place.

13. Packaging as claimed in claim 11, comprising a rectangular presentation collar capable of being supported on the shoulder.

14. Package for cut flowers comprising:

a) a rectangular crate defining an interior volume and having sloping side walls;

b) an upwardly facing channel having a base portion disposed close to the top portion of the sloping walls, the base portion extending between an inner flange and an outer flange and projecting outwardly of the interior volume, wherein the base of the channel is capable of supporting a foldable rectangular protective tube;

c) ribs disposed beneath the upwardly facing channel and supporting the base portion of the channel to bear the weight of the foldable rectangular protective tube and of another similar packaged stacked on top of said package; and d) a shoulder projecting into the interior volume and extending between the top of the sloping walls of the crate and the channel base or the bottom of the inner flange of the channel to prevent one crate from binding to another, similar crate when nested.

* * * * *